US009803864B2

(12) United States Patent
Singh et al.

(10) Patent No.: US 9,803,864 B2
(45) Date of Patent: Oct. 31, 2017

(54) TURBINE AIR FLOW CONDITIONER

(71) Applicant: General Electric Company, Schenectady, NY (US)

(72) Inventors: Arjun Singh, Bangalore (IN); Chandrasekhar Pushkaran, Bangalore (IN); Nishant Govindbhai Parsania, Bangalore (IN)

(73) Assignee: General Electric Company, Schnectady, NY (US)

( * ) Notice: Subject to any disclaimer, the term of this patent is extended or adjusted under 35 U.S.C. 154(b) by 550 days.

(21) Appl. No.: 14/313,198

(22) Filed: Jun. 24, 2014

(65) Prior Publication Data

US 2015/0369488 A1 Dec. 24, 2015

(51) Int. Cl.

| | |
|---|---|
| ***F23R 3/10*** | (2006.01) |
| ***F23R 3/28*** | (2006.01) |
| *F23R 3/04* | (2006.01) |
| *F23R 3/06* | (2006.01) |

(52) U.S. Cl.

CPC ..... *F23R 3/10* (2013.01); *F23R 3/286* (2013.01); *F23R 3/04* (2013.01); *F23R 3/045* (2013.01); *F23R 3/06* (2013.01)

(58) Field of Classification Search

CPC .... F23R 3/04; F23R 3/045; F23R 3/06; F23R 3/10; F23R 3/16; F23R 3/286; F23R 3/54; F23R 3/346; F23R 3/34; F02C 3/145

USPC ..... 60/746, 747

See application file for complete search history.

(56) References Cited

U.S. PATENT DOCUMENTS

| | | | | |
|---|---|---|---|---|
| 5,341,848 | A | 8/1994 | Laws | |
| 5,495,872 | A | 3/1996 | Gallagher et al. | |
| 5,762,107 | A | 6/1998 | Laws | |
| 6,438,961 | B2 * | 8/2002 | Tuthill | F23C 7/004 60/737 |
| 7,762,074 | B2 | 7/2010 | Bland et al. | |
| 8,234,872 | B2 * | 8/2012 | Berry | F23M 9/02 239/590.3 |
| 2007/0227148 | A1 * | 10/2007 | Bland | F23R 3/04 60/752 |
| 2010/0064693 | A1 * | 3/2010 | Koenig | F01D 9/023 60/760 |
| 2012/0111013 | A1 * | 5/2012 | Parsania | F23C 7/004 60/737 |
| 2013/0061598 | A1 * | 3/2013 | Widener | F23R 3/286 60/776 |
| 2013/0125548 | A1 | 5/2013 | Dutta et al. | |
| 2014/0116058 | A1 * | 5/2014 | Chen | F23R 3/002 60/754 |
| 2014/0190174 | A1 * | 7/2014 | Melton | F23R 3/46 60/776 |
| 2016/0178202 | A1 * | 6/2016 | Antoniono | F23R 3/10 60/782 |

* cited by examiner

*Primary Examiner* — William H Rodriguez
*Assistant Examiner* — Thomas Burke
(74) *Attorney, Agent, or Firm* — Nixon & Vanderhye P.C.

(57) ABSTRACT

A turbine combustor section has a flow conditioner including a plurality of conduits arranged to convey pressurized air to an air chamber for entrance into a plurality of fuel nozzles. Each conduit includes an inlet configured to receive the pressurized air from an annular passage and an outlet configured to deliver the pressurized air to the air chamber. A cross-sectional area of each conduit varies between the inlet and the outlet so as to reduce a pressure drop across the flow conditioner.

22 Claims, 10 Drawing Sheets

TURBINE AIR FLOW CONDITIONER

FIELD OF THE INVENTION

This invention relates generally to turbine engines, and more particularly to an air flow conditioning system to improve air distribution within an air chamber.

BACKGROUND OF THE INVENTION

Fuel-air mixing affects engine performance and emissions in a variety of engines, such as turbine engines. For example, a gas turbine engine may employ one or more fuel nozzles to intake air and fuel to facilitate fuel-air mixing in a combustor. The nozzles may be located in a head end portion of a turbine, and may be configured to intake an air flow to be mixed with a fuel input. Unfortunately, the air flow may not be distributed evenly among a plurality of nozzles, leading to an inconsistent mixture of fuel and air. Further, in a single nozzle embodiment, the air flow may be uneven within the nozzle due to the geometry within the head end of the turbine combustor. As such, uneven or non-uniform flow within the fuel nozzle may lead to inadequate mixing with fuel, thereby reducing performance and efficiency of the turbine engine. As a result, the air flow into the head end may cause increased emissions and reduce performance due to uneven flow of air into each nozzle and among a plurality of nozzles.

BRIEF SUMMARY OF THE INVENTION

One aspect of the disclosed technology relates to system for a gas turbine comprising a turbine combustor section, including: a plurality of fuel nozzles to distribute an air-fuel mixture in the combustor section; an annular passage to convey pressurized air; an air chamber arranged to deliver the pressurized air to the plurality of nozzle; and a flow conditioner including a plurality of conduits arranged to convey the pressurized air, each conduit including an inlet configured to receive the pressurized air from the annular passage and an outlet configured to deliver the pressurized air to the air chamber for entrance into the plurality of fuel nozzles, wherein each conduit has a tubular configuration adapted to extend between the annular passage and the air chamber, and wherein each conduit has a first portion having a first cross-sectional area and a second portion having a second cross-sectional area, the first cross-sectional area being smaller than the second cross-sectional area so as to reduce the size of a recirculation zone of the pressurized air in the air chamber.

Another aspect of the disclosed technology relates to a system for a gas turbine, comprising a turbine combustor section including: a plurality of fuel nozzles to distribute an air-fuel mixture in the combustor section; an annular passage to convey pressurized air; an air chamber arranged to deliver the pressurized air to the plurality of nozzle; and a flow conditioner including a plurality of conduits arranged to convey the pressurized air, each conduit including an inlet configured to receive the pressurized air from the annular passage and an outlet configured to deliver the pressurized air to the air chamber for entrance into the plurality of fuel nozzles, wherein a cross-sectional area of each conduit varies between the inlet and the outlet so as to reduce a pressure drop across the flow conditioner.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

As discussed in detail below, various embodiments of air flow conditioners and related structures may be employed to improve the performance and reduce emissions of a turbine engine. For example, the disclosed air flow conditioners may be disposed in a head end region of a gas turbine combustor, such that the air flow conditioner improves the distribution and uniformity of air flow to one or more fuel nozzles. Accordingly, the improved and balanced flow of air to the one or more fuel nozzles will lead to more predictable mixtures of air and fuel within the combustor, thereby improving performance.

Figure 1:
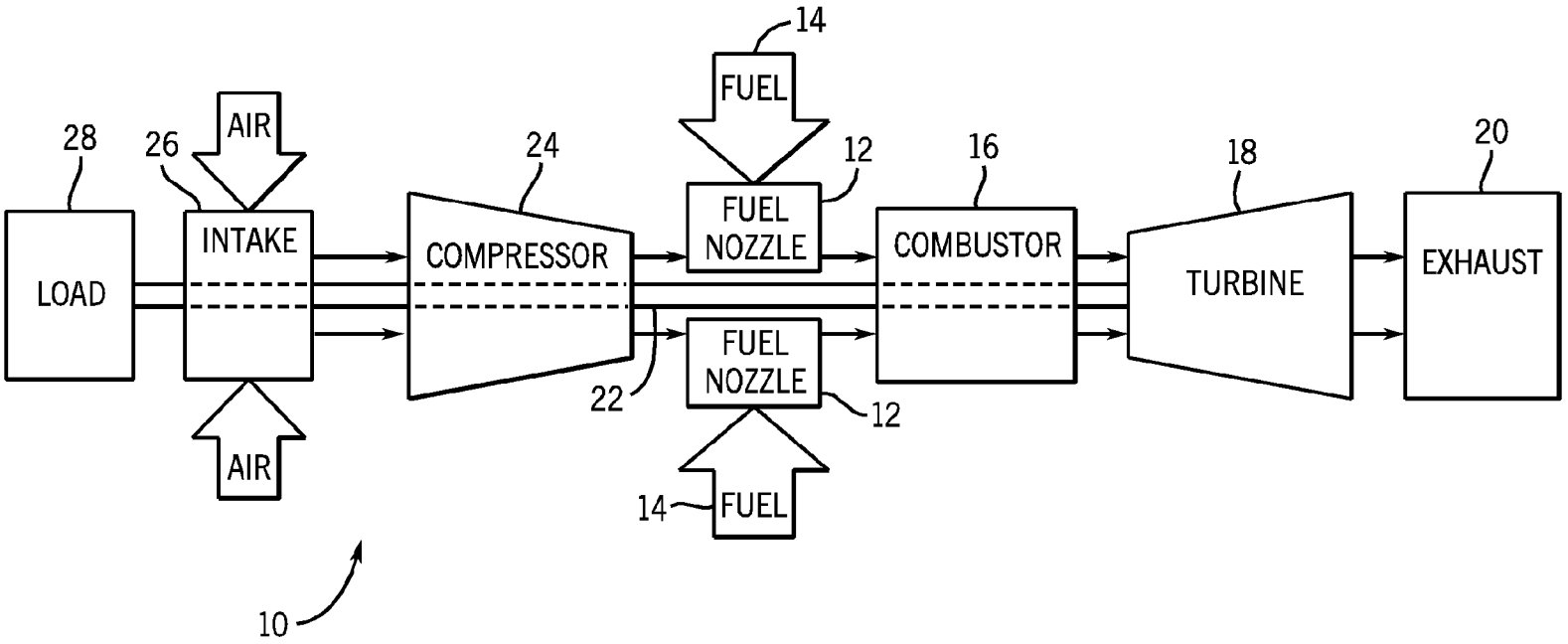
FIG. 1 is a block diagram of a turbine system having an air flow conditioner in accordance with an example of the disclosed technology.

Turning now to the drawings and referring first to FIG. 1, a block diagram of an embodiment of a turbine system 10 is illustrated. As discussed in detail below, the disclosed turbine system 10 may employ an air flow conditioner for improving the performance and reducing emissions from the turbine system 10. The turbine system 10 may use liquid or gas fuel, such as natural gas and/or a hydrogen rich synthetic gas, to run the turbine system 10. As depicted, a plurality of fuel nozzles 12 intakes a fuel supply 14, mixes the fuel with air, and distributes the air-fuel mixture into a combustor 16. The air-fuel mixture combusts in a chamber within combustor 16, thereby creating hot pressurized exhaust gases.

The combustor 16 directs the exhaust gases through a turbine 18 toward an exhaust outlet 20. As the exhaust gases pass through the turbine 18, the gases force one or more turbine blades to rotate a shaft 22 along an axis of the system 10. As illustrated, the shaft 22 may be connected to various components of the turbine system 10, including a compressor 24. The compressor 24 also includes blades that may be coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. As will be understood, the load 28 may include any suitable device capable of being powered by the rotational output of turbine system 10.

Figure 2:
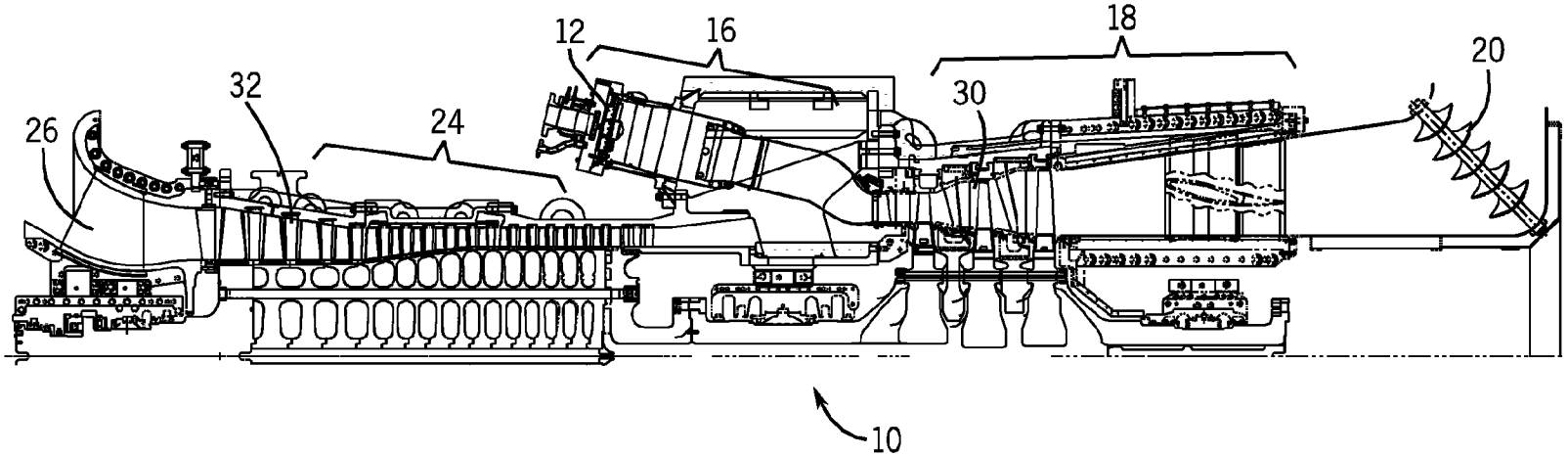
FIG. 2 is a cross sectional side view of the turbine system, as illustrated in FIG. 1, with a combustor having one or more fuel nozzles.

FIG. 2 illustrates a cross sectional side view of an embodiment of the turbine system 10 schematically depicted in FIG. 1. The turbine system 10 includes one or more fuel nozzles 12 located inside one or more combustors 16. In operation, air enters the turbine system 10 through the air intake 26 and may be pressurized in the compressor 24. The compressed air may then be mixed with gas for combustion within combustor 16. For example, the fuel nozzles 12 may inject a fuel-air mixture into the combustor 16 in a suitable ratio for optimal combustion, emissions, fuel consumption, and power output. The combustion generates hot pressurized exhaust gases, which then drive one or more blades 30 within the turbine 18 to rotate the shaft 22 and, thus, the compressor 24 and the load 28. The rotation of the turbine blades 30 causes a rotation of the shaft 22, thereby causing blades 32 within the compressor 22 to draw in and pressurize the air received by the intake 26.

As discussed in detail below, an embodiment of the turbine system 10 includes certain structures and components within a head end of the combustor 16 to improve flow of air into the fuel nozzles 12, thereby improving performance and reducing emissions. For example, an air flow conditioner 50, including a stepped hole (e.g., stepped conveyance path/passageway, e.g., in a conduit), may be placed in the air flow path into an air chamber, wherein the stepped hole reduces the total size of downstream recirculation zones to improve distribution of air into the fuel nozzles 12, thereby improving the fuel-air mixture ratio and enhancing accuracy of the ratio. By reducing the total size of the recirculation zones downstream of an inlet of the flow conditioner, the pressure drop across the flow conditioner is also reduced.

Figure 3:
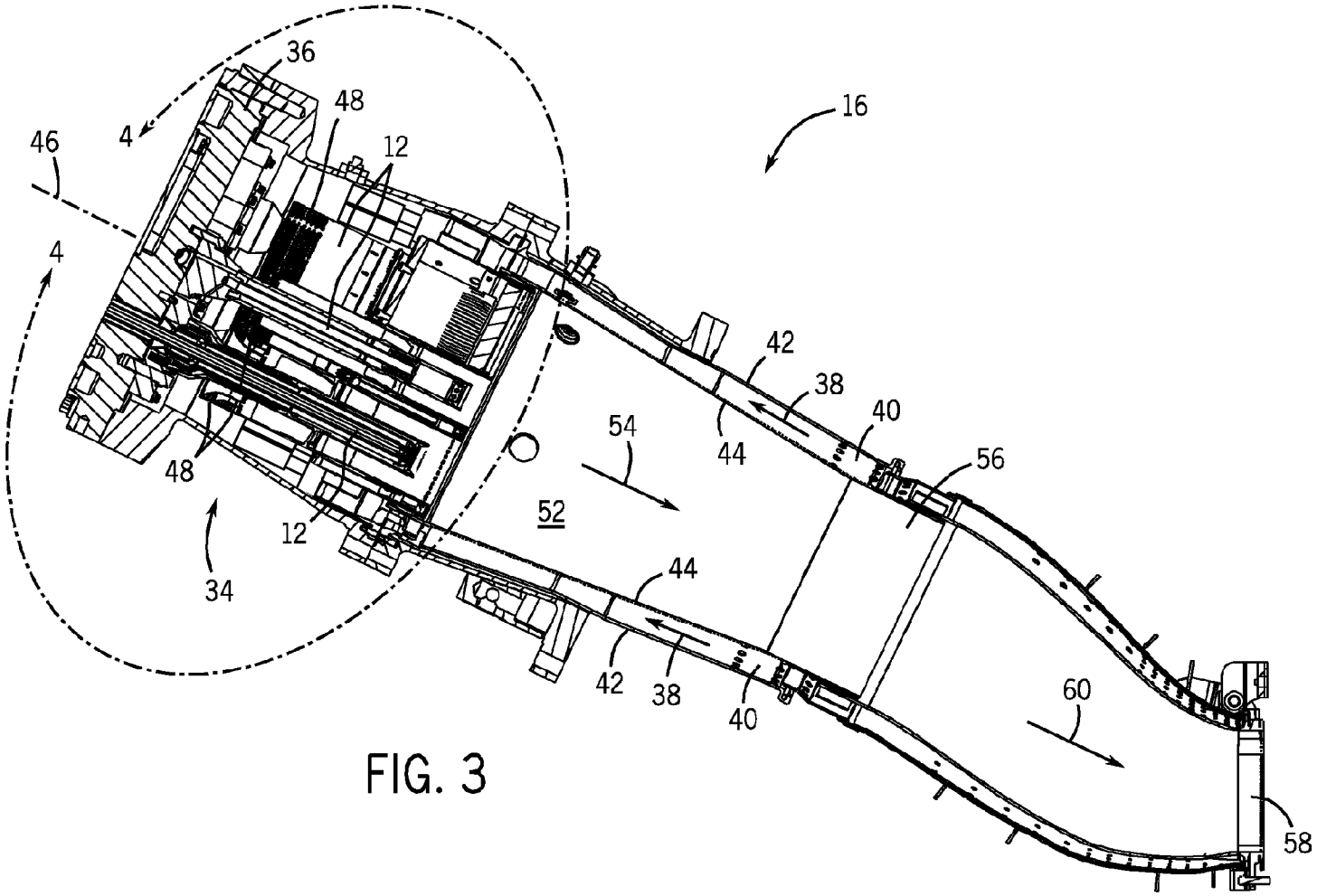
FIG. 3 is a cross sectional side view of the combustor having one or more fuel nozzles, as illustrated in FIG. 2, which may be positioned to draw compressed air from a head end region.

FIG. 3 is a cross sectional side view of an embodiment of the combustor 16 having one or more fuel nozzles 12, which may be positioned to draw compressed air from a head end region 34. An end cover 36 may include conduits or channels that route fuel and/or pressurized gas to the fuel nozzles 12. Compressed air 38 from the compressor 24 flows into the combustor 16 through an annular passage 40 formed between a combustor flow sleeve 42 and a combustor liner 44. The compressed air 38 flows into the head end region 34, which contains a plurality of fuel nozzles 12. In particular, in certain embodiments, the head end region 34 may include a central fuel nozzle 12 extending through a central longitudinal axis 46 of the head end region 34 and a plurality of outer fuel nozzles 12 disposed around the central longitudinal axis 46. However, in other embodiments, the head end region 34 may include only one fuel nozzle 12 extending through the central longitudinal axis 46. The particular configuration of fuel nozzles 12 within the head end region 34 may vary between particular designs.

In general, however, the compressed air 38 which flows into the head end region 34 may flow into the fuel nozzles 12 through a nozzle inlet flow conditioner having inlet perforations 48, which may be disposed in outer cylindrical walls of the fuel nozzles 12. As discussed in greater detail below, an air flow conditioner 50 may break up large scale flow structures (e.g., a single annular jet) of the compressed air 38 into smaller scale flow structures as the compressed air 38 is routed into the head end region 34. In addition, the air flow conditioner 50 guides or channels the air flow in a manner providing more uniform air flow distribution among the different fuel nozzles 12, which also improves the uniformity of air flow into each individual fuel nozzle 12. Accordingly, the compressed air 38 may be more evenly distributed to balance air intake among the fuel nozzles 12 within the head end region 34. The compressed air 38 that enters the fuel nozzles 12 via the inlet perforations 48 mixes with fuel and flows through an interior volume 52 of the combustor liner 44, as illustrated by arrow 54. The air and fuel mixture flows into a combustion cavity 56, which may function as a combustion burning zone. The heated combustion gases from the combustion cavity 56 flow into a turbine nozzle 58, as illustrated by arrow 60, where they are delivered to the turbine 18.

Figure 4:
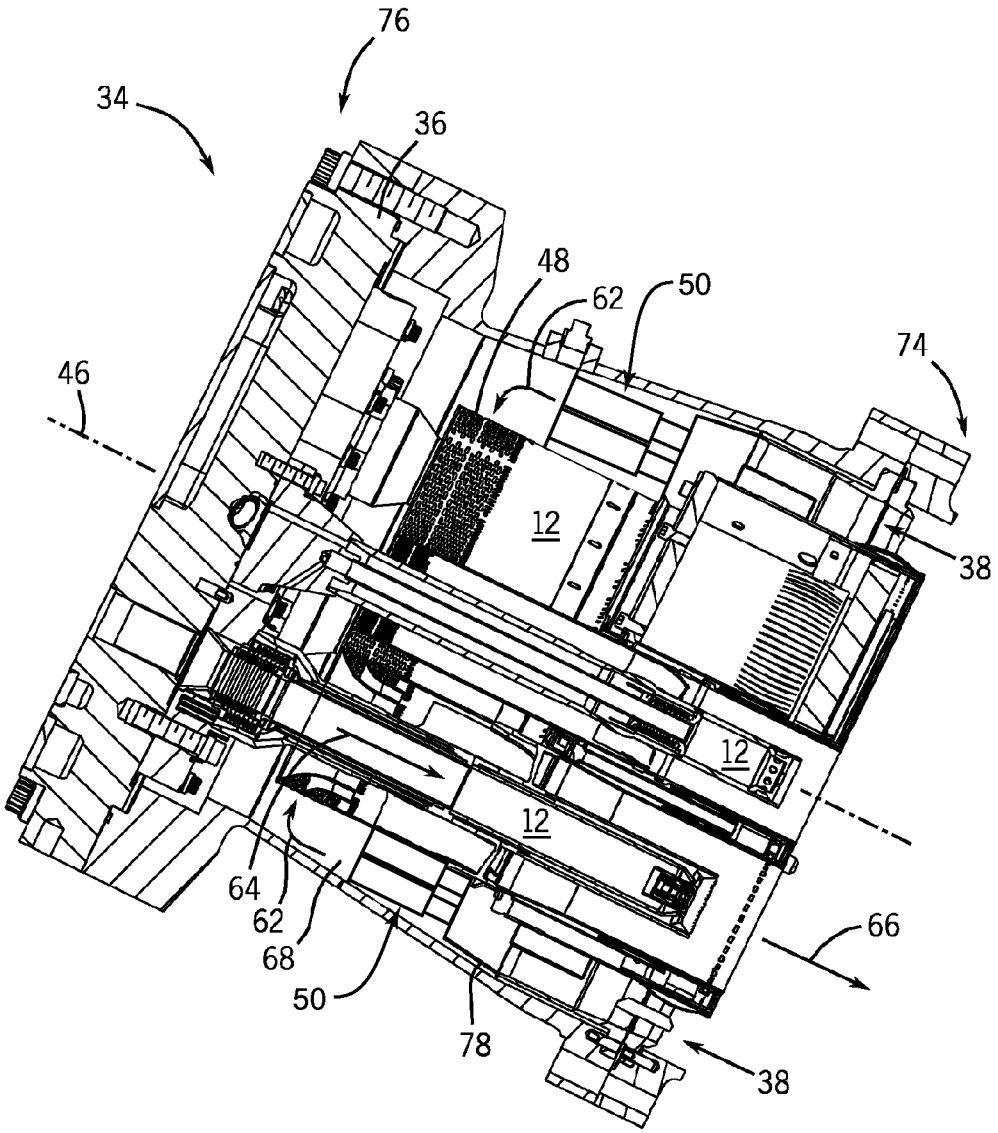
FIG. 4 is a cross sectional side view of the head end region within line 4-4 of FIG. 3, illustrating compressed air flowing into the head end region.

FIG. 4 is a cross sectional side view of an embodiment of the head end region 34 taken within line 4-4 of FIG. 3. As illustrated, the compressed air 38 may enter the head end region 34 and may turn into the inlet perforations 48 of the fuel nozzles 12, as illustrated by arrows 62. As discussed above, within the fuel nozzles 12, the compressed air 38 may be mixed with fuel and/or pressurized gas 64, which is introduced into the fuel nozzles 12 through conduits and valves through the end cover 36. The air/fuel mixture 66 may then be directed out of the head end region 34 and into the interior volume 52 of the combustor liner 44, as illustrated in FIG. 3.

As illustrated in FIG. 4, before entering the fuel nozzles 12, the compressed air 38 flowing into the head end region 34 (i.e., from a head end 74 to a combustor end 76) may pass through the air flow conditioner 50, which is disposed in an air chamber 68 within the head end region 34. The air chamber 68 may be described as an air flow dump region or an air flow reversal region, as the air flow expands into a larger volume and reverses directions from an upstream flow direction to a downstream flow direction. As discussed above, the air flow conditioner 50 may improve the performance of the combustor 16 by ensuring that the compressed air 38 enters the fuel nozzles 12 more uniformly. In particular, the air flow conditioner 50 uniformly distributes the compressed air 38 between fuel nozzles 12 as well as distributing the compressed air 38 uniformly across individual nozzle profiles. In other words, the air flow conditioner 50 is configured to uniformly supply the flow of compressed air 38 into the inlet perforations 48 of the fuel nozzles 12 and uniformly distribute the flow of compressed air 38 among the plurality of fuel nozzles 12.

Figure 5:
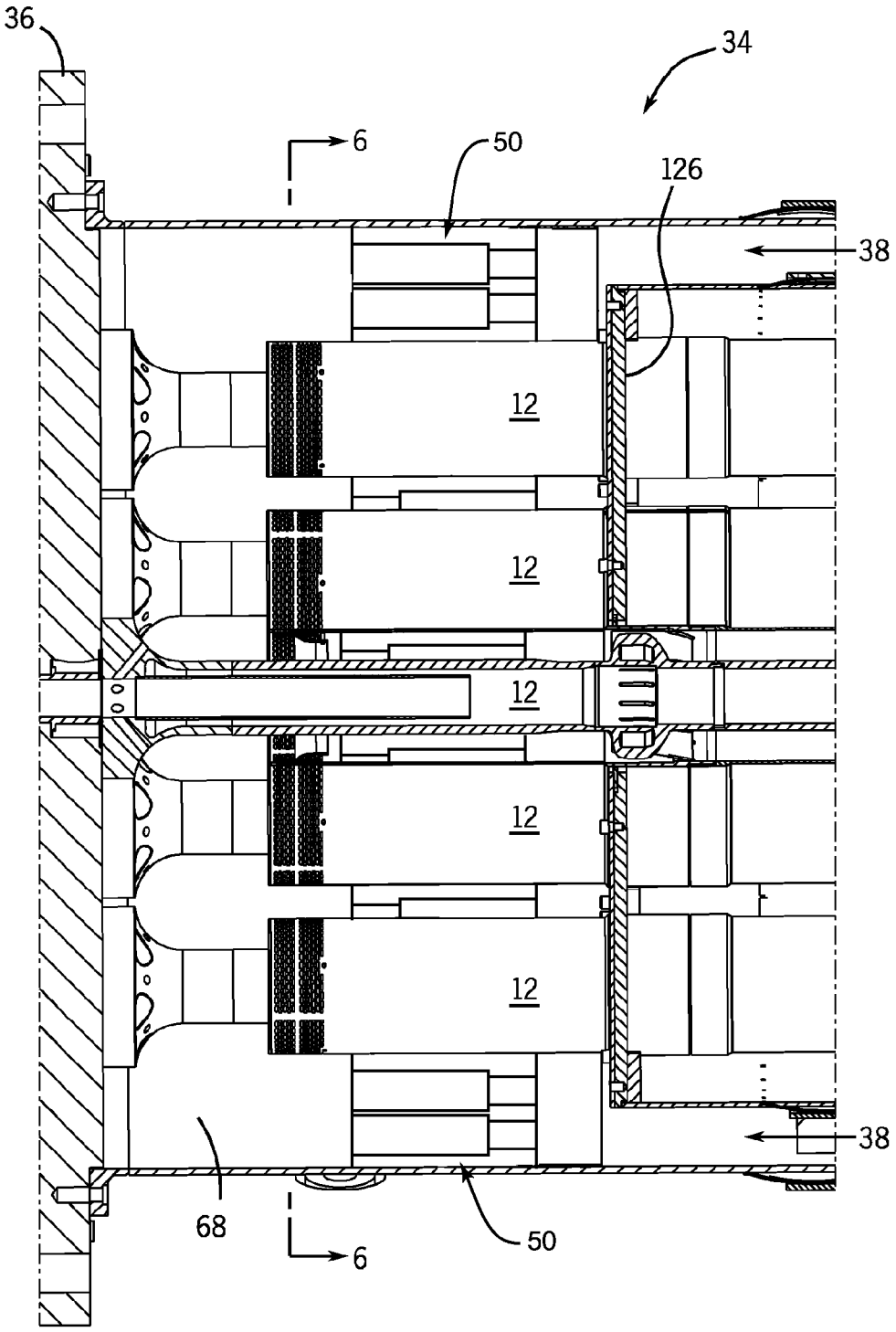
FIG. 5 is another cross sectional side view of the head end region within line 4-4 of FIG. 3, illustrating compressed air flowing into the head end region via a flow conditioner.

Returning now to FIG. 5, the air chamber 68 of the head end region 34 may be separated from the combustor 16 by a divider 126, otherwise known as a "cap."

Figure 6:
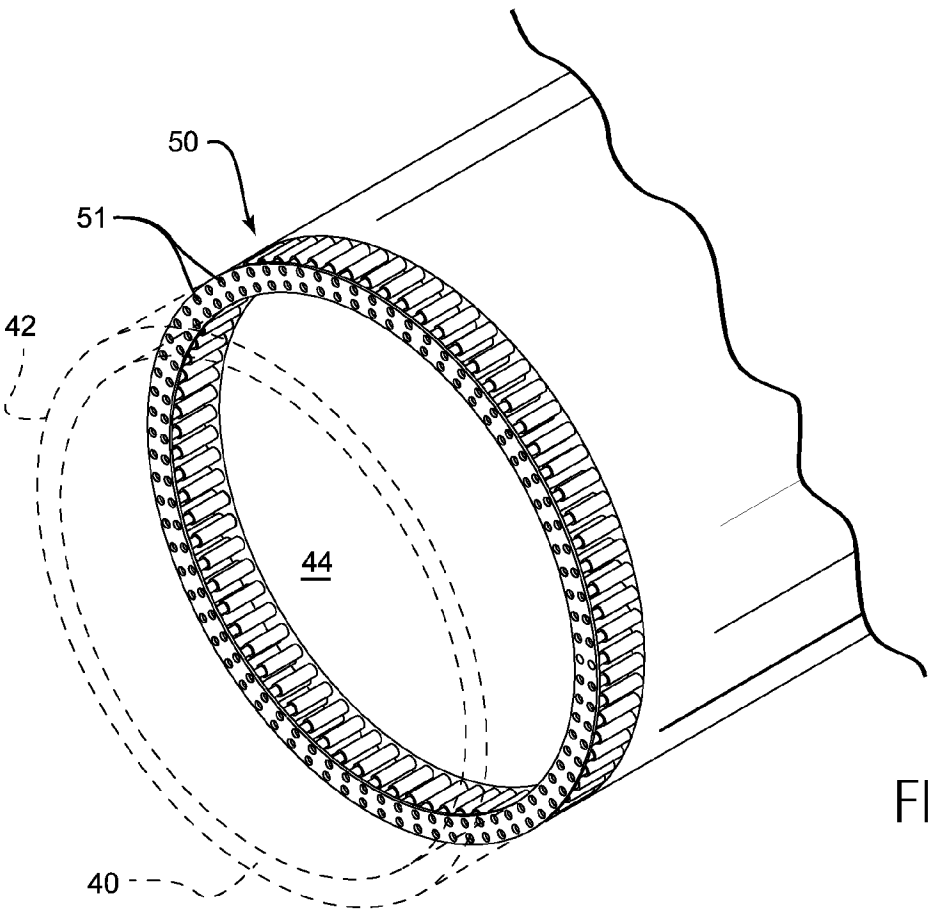
FIG. 6 is a perspective view of the flow conditioner of FIG. 5.

Referring to FIG. 6, the flow conditioner may be disposed in the annular passage 40. The flow conditioner 50 has an annular configuration and may be attached to the combustor flow sleeve 42 and/or the combustor liner 44. The flow conditioner comprises a plurality of individual conduits. In the illustrated example, the flow conditioner includes two spaced circumferential rows of conduits (e.g., a radially inner row and a radially outer row). It will be understood that the flow conditioner may includes any suitable number of conduits and/or rows of conduits. The compressed air 38 enters the flow conditioner 50 via inlet openings 51 of the conduits, as shown in FIG. 6.

Figure 7:
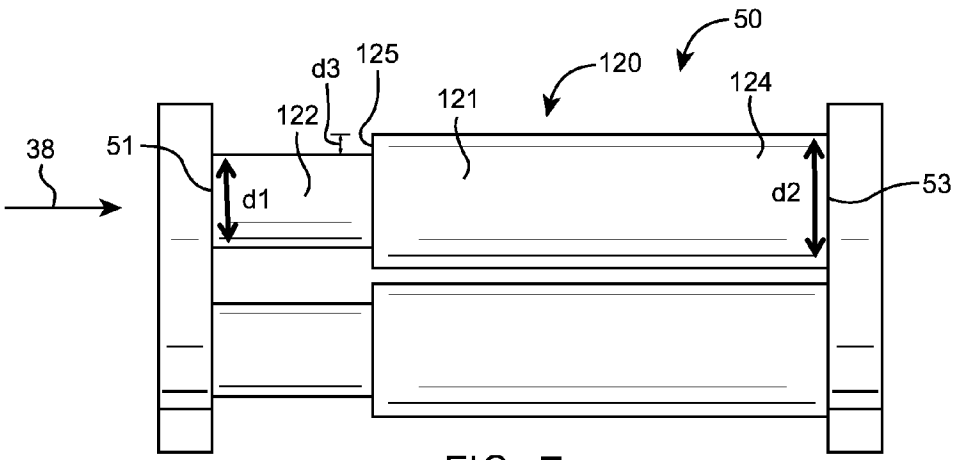
FIG. 7 is an enlarged detail of a portion of the flow conditioner of FIG. 5

Referring to FIG. 7, an enlarged detail section of the flow conditioner 50 is shown. The flow conditioner 50 includes a plurality of conduits 120. Each conduit 120 has an inlet opening 51 arranged to receive compressed air 38 from the annular passage and an outlet opening 53 arranged to deliver the compressed air to the air chamber 68. Each conduit 50 includes a stepped conveyance path 121 comprising a relatively smaller diameter portion 122 and a relatively larger diameter portion 124. The relatively smaller diameter portion 122 is associated with the inlet opening 51 and the relatively larger diameter portion 124 is associated with the outlet opening 53. A step 125 transitions the conduit between the relatively smaller diameter portion 122 and the relatively larger diameter portion 124.

Since the relatively smaller diameter portion 122 has a smaller diameter as compared to the relatively larger diameter portion 124, it also has a smaller cross-sectional area as compared to the relatively larger diameter portion. The multi-diameter nature of the conduit reduces the amount of pressure drop that would occur if the conduit had a constant diameter.

Figure 10:
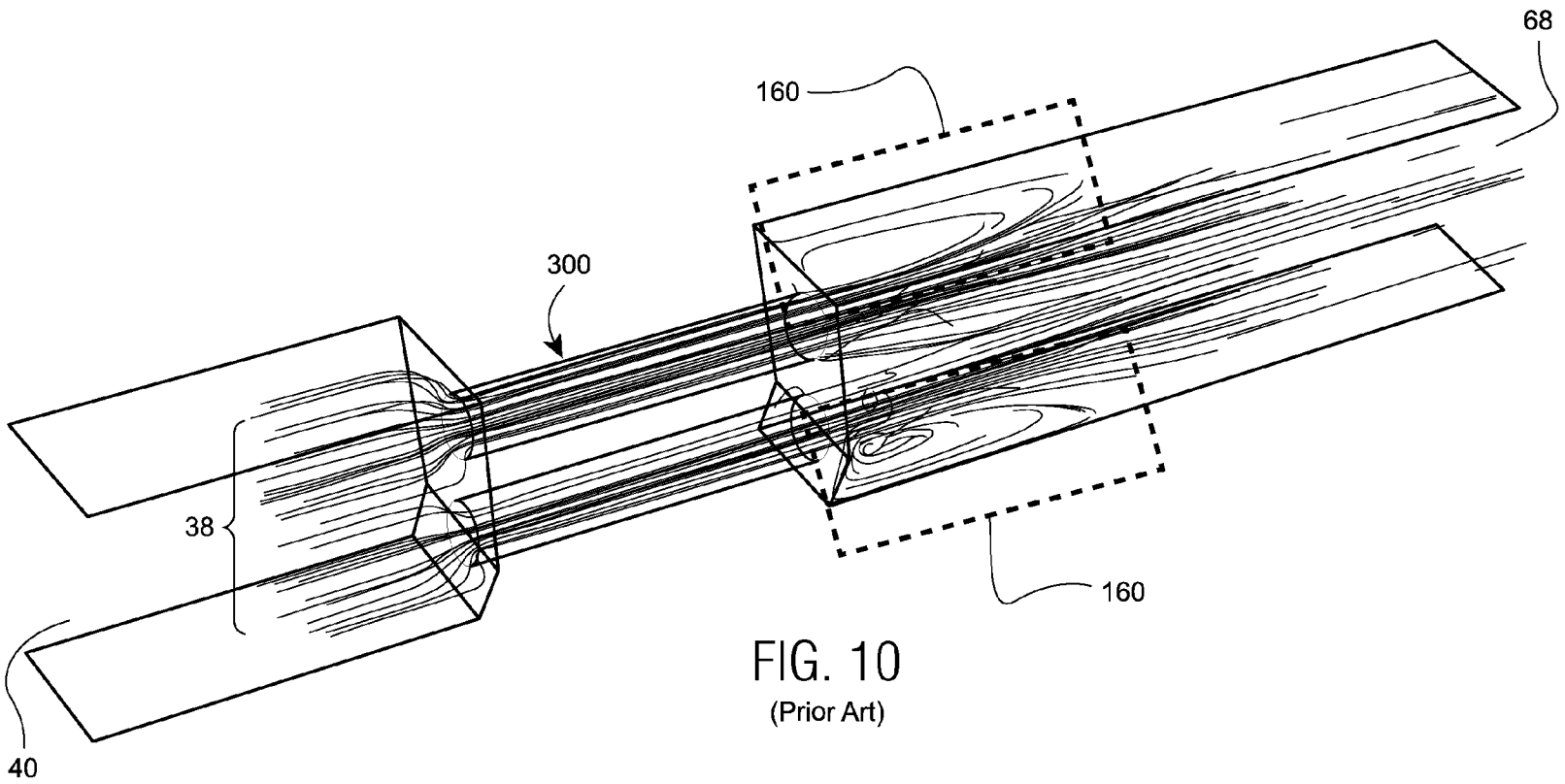
FIG. 10 (Prior Art)
FIG. 10 is a schematic illustration depicting a recirculation zone in an air chamber of a combustor section in accordance with a conventional turbine engine.

FIG. 10 illustrates a conduit 300 having a constant diameter. As the compressed air 38 expands into the air chamber 68, large recirculation zones 160 are formed as the compressed air fills up the larger open area of the air chamber 68. The size of the recirculation zones 160 is directly related to the amount of pressure drop across the flow conditioner 50.

Figure 11:
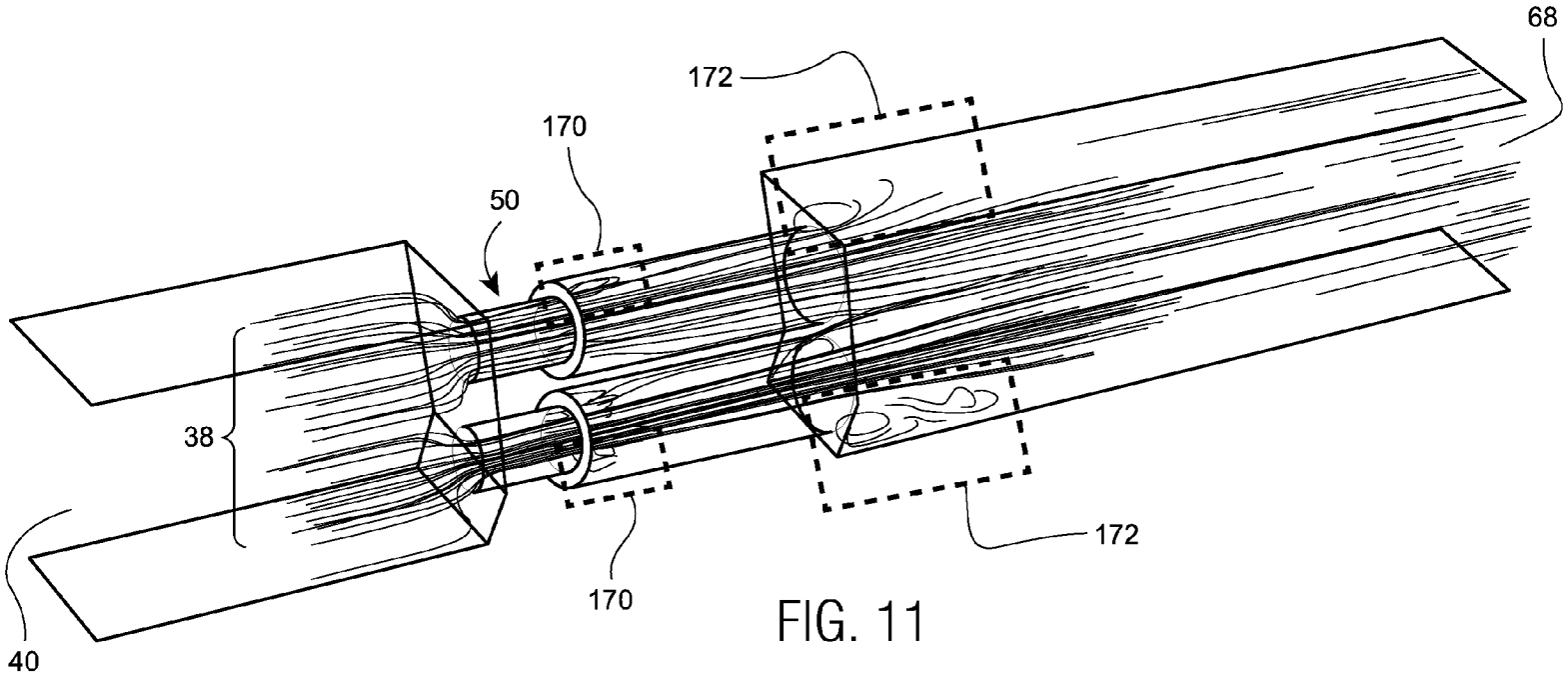
FIG. 11 is a schematic illustration depicting a recirculation zone in an air chamber of a combustor section in accordance with an example of the disclosed technology.

FIG. 11 illustrates a conduit having a diameter that varies. The step 125 causes an additional recirculation zone 170 to be formed as the compressed air 38 expands into the relatively larger diameter portion 124. However, the combined size of the recirculation zone 170 and the recirculation zone 172 is less than the size of the recirculation zone 160. Thus, the flow conditioner 50 (having a diameter that varies) reduces the pressure drop across the flow conditioner.

In the example of FIG. 7, d1 may be within the range of 0.3 to 0.56 inches, e.g., 0.43 inches, d2 may be within the range of 0.5 to 0.76 inches, e.g., 0.63 inches, and d3 may be within the range of 0.03 to 0.13, e.g., 0.5 or 0.1.

Figure 8:
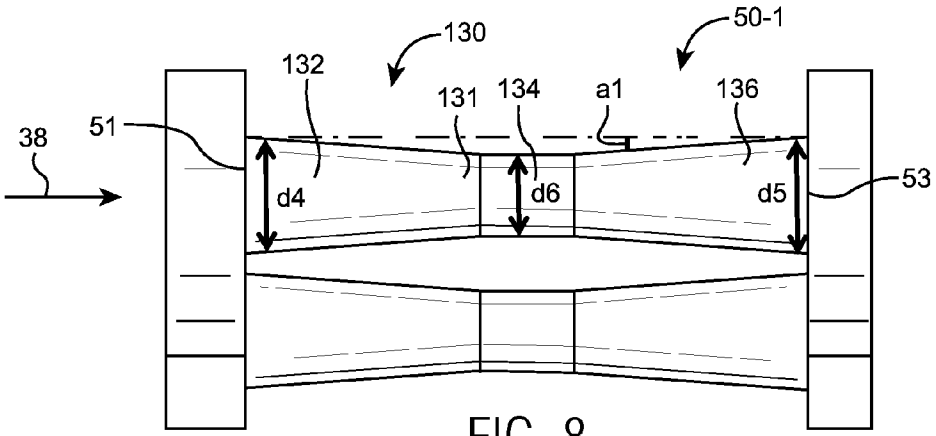
FIG. 8 is an enlarged detail of a portion of a flow conditioner in accordance with another example of the disclosed technology.

Referring to FIG. 8, an enlarged detail section of another example flow conditioner 50-1 is shown. The flow conditioner 50-1 includes a plurality of conduits 130. Each conduit 130 includes a convergent-divergent conveyance path 131 comprising a convergent portion 132, a relatively smaller diameter portion (constant diameter portion) 134 and a divergent portion 136. The convergent portion 132 is associated with the inlet opening 51 and the divergent portion 136 is associated with the outlet opening 53. The relatively smaller diameter portion 134 is disposed between the convergent portion 132 and the divergent portion 136.

The convergent portion 132 has a conical shape that converges in a flow direction of the compressed air 38. The divergent portion 136 has a conical shape that expands in the flow direction of the compressed air. As mentioned above, those skilled in the art will understand that the cross-sectional area of each respective portion of the conduit corresponds directly to the diameter (or size generally) of the conduit. The multi-diameter configuration of the conduit 130 reduces the total size of any recirculation zones downstream of the inlet opening 51 and therefore reduces the pressure drop across the flow conditioner 50-1, as compared to a constant diameter conduit (e.g., flow conditioner 300).

In the example of FIG. 8, d4 may be within the range of 0.5 to 0.76 inches, e.g., 0.63 inches, d5 may be within the range of 0.5 to 0.76 inches, e.g., 0.63 inches, d6 may be within the range of 0.3 to 0.56 inches, e.g., 0.43 inches, and a1 may be within the range of 3.0 to 5.5 degrees.

Figure 9:
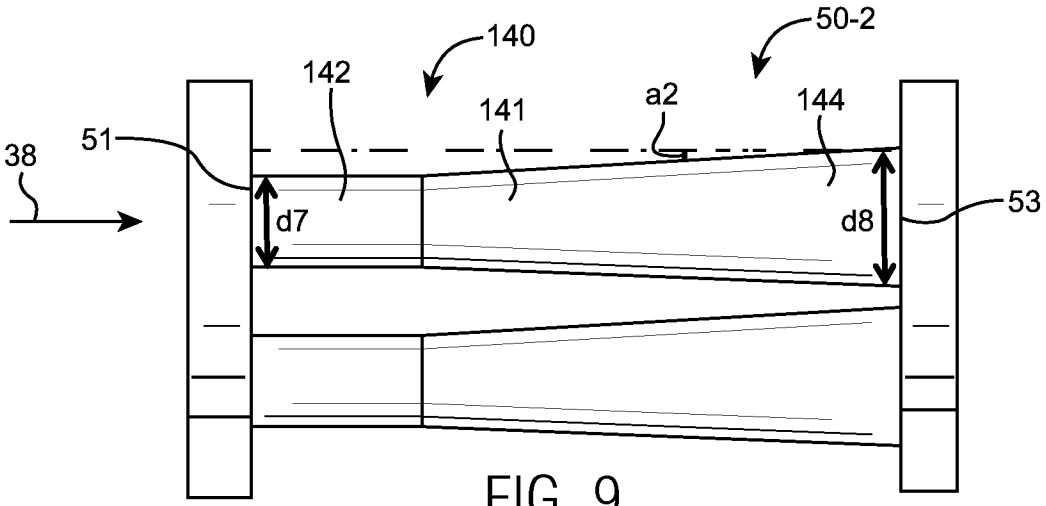
FIG. 9 is an enlarged detail of a portion of a flow conditioner in accordance with another example of the disclosed technology.

Referring to FIG. 9, an enlarged detail section of another example flow conditioner 50-2 is shown. The flow conditioner 50-2 includes a plurality of conduits 140. Each conduit 140 includes an expanded conveyance path 141 comprises a relatively smaller diameter portion (constant diameter portion) 142 and a conical expansion portion 144. The relatively smaller diameter portion 142 is associated with the inlet opening 51 and the conical expansion portion 144 is associated with the outlet opening 53.

The conical expansion portion 144 has a conical shape that expands in the flow direction of the compressed air. The multi-diameter configuration of the conduit 140 reduces the total size of any recirculation zones downstream of the inlet opening 51 and therefore reduces the pressure drop across the flow conditioner 50-2, as compared to a constant diameter conduit (e.g., flow conditioner 300).

In the example of FIG. 9, d7 may be within the range of 0.3 to 0.56 inches, e.g., 0.43 inches, d8 may be within the range of 0.5 to 0.76 inches, e.g., 0.63 inches, and a2 may be within the range of 1.3 to 4.0 degrees.

It is noted that the conduits described above may have shapes other than circular or tubular, such as elliptical or square, for example.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A system for a gas turbine, comprising:

a turbine combustor section, including:

a plurality of fuel nozzles to distribute an air-fuel mixture in the turbine combustor section;

an annular passage to convey pressurized air;

an air chamber arranged to deliver the pressurized air to the plurality of fuel nozzles; and a flow conditioner disposed in a head end region of the turbine combustor section and having an arc shape corresponding to the annular passage, the flow conditioner including a plurality of conduits arranged to convey the pressurized air, the plurality of conduits including a radially inner row of conduits and a radially outer row of conduits concentrically arranged with respect to one another, each conduit including an inlet configured to receive the pressurized air from the annular passage and an outlet configured to deliver the pressurized air to the air chamber for entrance into the plurality of fuel nozzles, wherein each conduit has a tubular configuration adapted to extend between the annular passage and the air chamber, and wherein each conduit has a first portion having a first cross-sectional area and a second portion having a second cross-sectional area, the first cross-sectional area being smaller than the second cross-sectional area so as to reduce a size of a recirculation zone of the pressurized air in the air chamber.

2. The system of claim 1, wherein the first portion of each conduit is at the inlet and the second portion of each conduit is at the outlet.

3. The system of claim 2, wherein the first portion is a relatively smaller diameter portion and the second portion is a relatively larger diameter portion, and wherein each conduit has a step which transitions from the relatively smaller diameter portion to the relatively larger diameter portion.

4. The system of claim 1, wherein the first portion is an intermediate portion arranged between the second portion and a third portion of each conduit, the third portion having a third cross-sectional area that is larger than the first cross-sectional area.

5. The system of claim 4, wherein the third portion has a conical configuration that converges gradually towards the intermediate portion.

6. The system of claim 5, wherein the second portion has a conical configuration that expands gradually away from the intermediate portion.

7. The system of claim 6, wherein the second portion expands at an angle between 3.0 and 5.5 degrees.

8. The system of claim 1, wherein the first portion of each conduit is a relatively smaller diameter portion and the second portion of each conduit is a conical expansion portion having a diameter that gradually expands towards the outlet.

9. The system of claim 8, wherein the conical expansion portion expands at an angle between 1.5 and 4 degrees.

10. The system of claim 1, wherein the flow conditioner has an annular shape.

11. A gas turbine, comprising:

a compressor;

a turbine section; and the system of claim 1.

12. A system for a gas turbine, comprising:

a turbine combustor section, including:

a plurality of fuel nozzles to distribute an air-fuel mixture in the turbine combustor section;

an annular passage to convey pressurized air;

an air chamber arranged to deliver the pressurized air to the plurality of fuel nozzles; and a flow conditioner disposed in a head end region of the turbine combustor section and having an arc shape corresponding to the annular passage, the flow conditioner including a plurality of conduits arranged to convey the pressurized air, the plurality of conduits including a radially inner row of conduits and a radially outer row of conduits concentrically arranged with respect to one another, each conduit including an inlet configured to receive the pressurized air from the annular passage and an outlet configured to deliver the pressurized air to the air chamber for entrance into the plurality of fuel nozzles, wherein a cross-sectional area of each conduit varies between the inlet and the outlet so as to reduce a pressure drop across the flow conditioner.

13. The system of claim 12, wherein the flow conditioner is disposed circumferentially about the plurality of fuel nozzles.

14. The system of claim 12, wherein each conduit has a tubular configuration arranged to be disposed between the annular passage and the air chamber.

15. The system of claim 12, wherein each conduit has a first portion having a first cross-sectional area and a second portion having a second cross-sectional area that is different from the first cross-sectional area.

16. The system of claim 15, wherein the first cross-sectional area is at the inlet and the second cross-sectional area is at the outlet.

17. The system of claim 15, wherein the first portion is a relatively smaller diameter portion and the second portion is a relatively larger diameter portion, and wherein each conduit has a step which transitions from the relatively smaller diameter portion to the relatively larger diameter portion.

18. The system of claim 15, wherein the first portion is an intermediate portion arranged between the second portion and a third portion of each conduit, the third portion having a third cross-sectional area that is larger than the first cross-sectional area.

19. The system of claim 18, wherein the third portion has a conical configuration that converges gradually towards the intermediate portion.

20. The system of claim 15, wherein the first portion of each conduit is a relatively smaller diameter portion and the second portion of each conduit is a conical expansion portion having a diameter that gradually expands towards the outlet.

21. The system of claim 12, wherein the flow conditioner has an annular shape.

22. The system of claim 1, wherein, in a cross-sectional view, each conduit is symmetrical in a radial direction of the flow conditioner with respect to a central axis of each conduit.

* * * * *